US009682803B2

(12) United States Patent
Fallat et al.

(10) Patent No.: US 9,682,803 B2
(45) Date of Patent: Jun. 20, 2017

(54) UV-PROTECTED CONTAINER WITH PRODUCTS HAVING DYES OR LAKES

(75) Inventors: Peter J. Fallat, Whitehouse Station, NJ (US); Derek Samaroo, Edison, NJ (US); John Malloy, Bridgewater, NJ (US); Thomas Boyd, Metuchen, NJ (US); Joel Millon, Houilles (FR); Yu Shi, Branchburg, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 38 days.

(21) Appl. No.: 13/056,873

(22) PCT Filed: Jul. 29, 2009

(86) PCT No.: PCT/US2009/052083

§ 371 (c)(1),
(2), (4) Date: Mar. 10, 2011

(87) PCT Pub. No.: WO2010/014692

PCT Pub. Date: Feb. 4, 2010

(65) Prior Publication Data

US 2011/0147237 A1 Jun. 23, 2011

Related U.S. Application Data

(60) Provisional application No. 61/084,875, filed on Jul. 30, 2008.

(51) Int. Cl.

| | |
|---|---|
| ***B65D 85/14*** | (2006.01) |
| ***B65D 35/08*** | (2006.01) |
| ***B65D 81/30*** | (2006.01) |

(52) U.S. Cl.

CPC ..... *B65D 35/08* (2013.01); *B65D 81/30* (2013.01)

(58) Field of Classification Search

CPC ..... B65D 35/08; B65D 81/30

USPC ..... 206/277, 45.31, 63.5, 524.6; 222/23; 423/473; 424/49

See application file for complete search history.

(56) References Cited

U.S. PATENT DOCUMENTS

| | | | | |
|---|---|---|---|---|
| 4,518,578 | A * | 5/1985 | Hayes et al. | 424/49 |
| 5,226,538 | A | 7/1993 | Roselle | |
| 5,328,975 | A | 7/1994 | Hanson et al. | |
| 5,385,776 | A | 1/1995 | Maxfield et al. | |
| 5,401,587 | A | 3/1995 | Motohiro et al. | |
| 5,556,678 | A | 9/1996 | Jupin et al. | |

(Continued)

FOREIGN PATENT DOCUMENTS

| | | |
|---|---|---|
| CN | 1113870 A | 12/1995 |
| JP | 07040954 | 2/1995 |

(Continued)

OTHER PUBLICATIONS

International Preliminary Report on Patentability and Written Opinion of the International Searching Authority [EPO] for corresponding International Application No. PCT/US2009/052083 dated Feb. 11, 2011.

*Primary Examiner* — Anthony Stashick
*Assistant Examiner* — James M Van Buskirk

(57) ABSTRACT

A container and product system comprising a container adapted to house a product, the container comprising a substantially transparent multi-layered laminate body and a product housed in the container, the product comprising dyes, lakes, or both.

20 Claims, 1 Drawing Sheet

(56) References Cited

U.S. PATENT DOCUMENTS

| | | | | |
|---|---|---|---|---|
| 5,916,685 | A | 6/1999 | Frisk | |
| 6,117,541 | A | 9/2000 | Frisk | |
| 6,126,923 | A * | 10/2000 | Burke et al. | 424/49 |
| 6,203,923 | B1 | 3/2001 | Bansleben et al. | |
| 6,217,962 | B1 | 4/2001 | Werth | |
| 6,447,860 | B1 | 9/2002 | Mueller et al. | |
| 6,592,449 | B2 | 7/2003 | Cipolla et al. | |
| 6,669,929 | B1 | 12/2003 | Boyd et al. | |
| 2002/0028861 | A1* | 3/2002 | Andrews et al. | 524/100 |
| 2004/0126332 | A1 | 7/2004 | Boyd et al. | |
| 2004/0136924 | A1 | 7/2004 | Boyd et al. | |
| 2005/0047990 | A1* | 3/2005 | Rees et al. | 423/473 |
| 2006/0235116 | A1 | 10/2006 | Lazzari et al. | |
| 2007/0267444 | A1 | 11/2007 | de Buzzaccarini et al. | |
| 2008/0109973 | A1* | 5/2008 | Farrell et al. | 15/4 |

FOREIGN PATENT DOCUMENTS

| | | |
|---|---|---|
| JP | 3109486 | 11/2000 |
| JP | 2006341887 | 12/2006 |
| WO | WO 99/49991 | 10/1999 |
| WO | WO 01/85568 | 11/2001 |

* cited by examiner

UV-PROTECTED CONTAINER WITH PRODUCTS HAVING DYES OR LAKES

CROSS-REFERENCE TO RELATED PATENT APPLICATIONS

The present application is a national stage entry under 35 U.S.C. §371 of International Patent Application No. PCT/US2009/052083, filed Jul. 29, 2009, which in turn claims the benefit under 35 U.S.C. 119(e) of U.S. Provisional Application No. 61/084,875, filed Jul. 30, 2008, the entireties of which are hereby incorporated by reference.

FIELD OF THE INVENTION

The invention relates to a substantially transparent container filled with a colored product.

BACKGROUND

Tubes containing substantially transparent multi-layer laminate structures have been used to market dentifrice products or health and beauty care products for many years. These tubes have been particularly effective for products containing pigments as such pigments are generally stable over the effective life of the product. However, many dentifrice products or health and beauty care products contain dyes and or lakes. Such dyes and lakes will discolor or degrade upon exposure to light. Hence substantially transparent multi-layer laminate containers for products containing dyes and lakes are not as suitable as they do not offer appropriate protection.

BRIEF SUMMARY

An aspect of the present invention is directed to a container and product system comprising (a) a container adapted to house a product, the container comprising a substantially transparent multi-layered laminate body wherein the body allows less than 10% transmission of the ultra violet light between 280 nm and 400 nm; (b) a product housed in the container, the product comprising dyes, lakes, or both.

Another aspect of the invention is directed to a container and system comprising (a) a container adapted to house a product, the container comprising a substantially transparent multi-layered laminate body, wherein the body comprises an effective amount of at least one ultra violet light absorber; (b) a product housed in the container, the product comprising dyes, lakes, or both.

DETAILED DESCRIPTION

Figure 1:
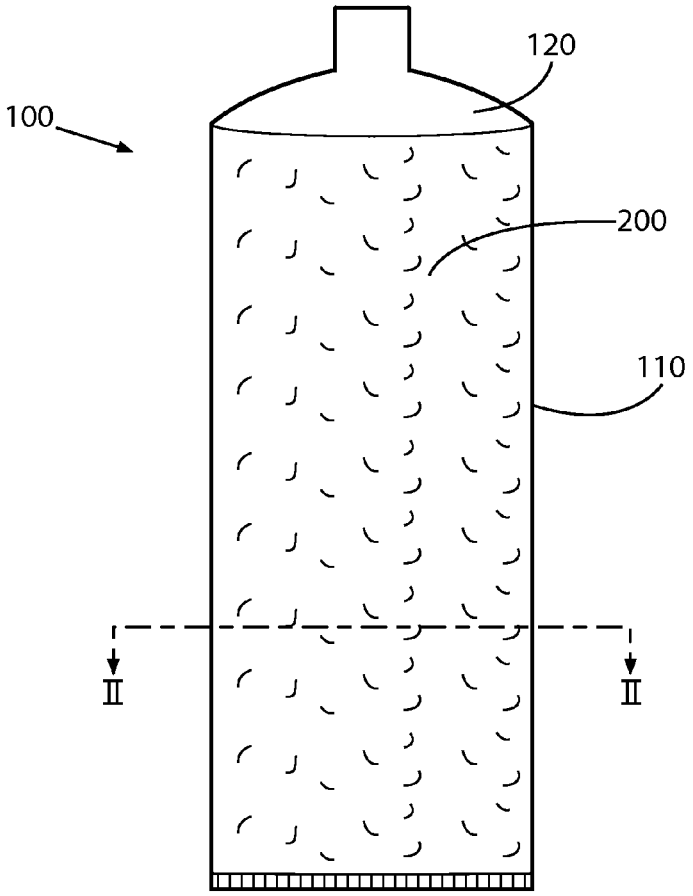
FIG. 1 shows a container having a tubular sidewall and filled with a product in accordance with an aspect of the invention.
Figure 2:
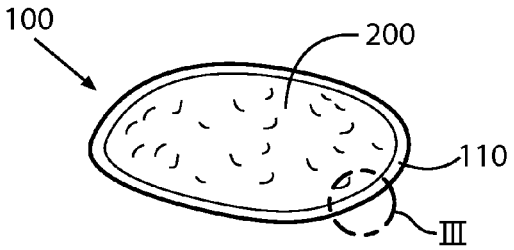
FIG. 2 shows a cross section of the container taken along line 2-2 of FIG. 1.

FIGS. 1 and 2 illustrate a container and product system 100 whereby the utility of the container is substantially enhanced for the product contained therein, in particular, for a product containing dyes, lakes, or both. The body 110 of the container is substantially transparent when filled with the product 200 to allow the product to be readily seen by the consumer. The dispensing end 120 which may have a neck and cap may be transparent, translucent, or opaque.

As noted, the product 200 contains dyes and/or lakes. Dyes dissolve in water but are not soluble in oils. Lakes are the combination of dyes and insoluble material. Lakes tint by dispersion and are not oil soluble, but are oil dispersible. Lakes are generally more stable than dyes and are ideal for coloring products containing fats and oils or items lacking sufficient moisture to dissolve dyes. Two such ingredients are FD&C Blue No. 1 and FD&C Yellow No. 5. However, both dyes and lakes will discolor or degrade upon exposure to light.

In addition to the dyes and lakes, the product may contain suspended pieces having functional shapes and/or non-functional shapes. Products with functional shapes effectively communicate specific benefits to the consumer such as beads containing mouthwash to freshen breath or containing flavorants or sweeteners. That is, the functional shapes provide a visual cue to the consumer as to the content of the product. Non-functional shapes are generally to create decorative interest in the product. The suspended pieces may be spherical shaped pieces such as beads or polyhedron shaped pieces such as pieces having quadrangular and triangular shapes. The suspended pieces may be of the same or of different colors. For example there may be white beads or multi-colored rectangular pieces. Examples of products containing functional shapes are described, for example, in U.S. Pat. No. 6,669,929 and US Publication 2004/0136924, which disclosures are hereby incorporated by reference in their entirety. A substantially transparent container allows the suspended pieces to be readily seen by the consumer.

The product may be for skin care such as moisturizers, cleansers or body washes, hair care, such as shampoos, and conditioners, body care such as deodorants or antiperspirants, or oral health care such as dentrifices. In particular, the product is a dentrifice which includes toothpastes, gels, and combinations thereof.

In particular, the product is a dentrifice gel. The refractive index of the gels range from about 1.33 to about 1.47, from about 1.40 to about 1.46, or from about 1.43 to about 1.45. For example, the refractive index may be about 1.44.

The container and product system in accordance with aspects of the invention has improved contact clarity between the product and the container. That is, the color or visual appearance of the product is enhanced by contact with the container. For example, a container may appear hazy without a product contained therein, but when filled with the product, the container is substantially transparent providing clear visibility to the contents of the container. In addition, the container alters or enhances the coloration or tint of the product therein.

Appearance of a product in the container is a general function of the gloss, color and transparency of the container.

As noted, the container appears hazy when empty. Haze is the scattering of light as it passes through a transparent material, resulting in poor visibility and/or glare. Haze can be inherent in the material as a result of the extrusion and laminating process or as a result of surface texture. Luminous (light) transmittance measures the amount of light that passes through a sample.

The degree of haze is less than 40 as measured by ASTM D1003.

The container also can be defined by clarity. The degree of clarity is greater that 90 as measured by ASTM D1003.

The container also can be defined by transmittance. Light transmittance is the percentage of incident light that passes through a sample. The degree of transmittance is greater than 78 as measured by ASTM D1003.

In addition the container protects the product contained therein from degradation due to light. This maintains the desired appearance or visual cue of the product for the benefit of the consumer throughout the effective life of the product.

Figure 3:
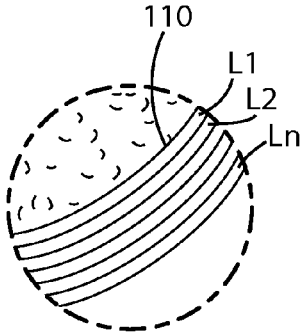
FIG. 3 shows an enlarged view of the multi-layer structure of the sidewall shown in FIG. 2 having n layers.

In accordance with at least one aspect of the invention, a container has a body 110 comprising a multi-layer laminate structure having $L_n$ layers where n is an integer. See FIG. 3. The laminate structure generally has from about 5 to about 13 layers of flexible materials, typically about 7 to about 11 layers. In one example, the laminate structure has 9 layers. The layers may comprise any suitable mixture of materials including but not limited to polyamides, polyvinyl acetate (PVA), ethylene vinyl alcohol (EVOH), polyethylene terephthalate (PET), and polyolefins from companies such as DuPont, Teijin Films, Eastman Chemical Company, Kuraray Co. Ltd, Sealed Air Corporation and Huhtamaki.

The laminate structure may be partially decorated or undecorated allowing the product to be visible through the laminate structure.

The containers may be of any suitable shape and size. Suitable shapes include tubular, square, rectangular, and cylindrical. In one aspect, the containers may be a tubular shaped, multi-layered collapsible package with contents of 10 ml to 300 ml with a sideseam, an end seal, tube head, and closure. In another aspect, the containers may be square or rectangular shaped multilayered collapsible packages with contents of 0.5 ml to 50 ml. In a further aspect the containers are cylindrical and semi-rigid with contents of 200 ml to 400 ml with a sideseam, and rigid ends and closure. These aspects are for exemplary purposes and are not intended to limit the size or shape of the container.

The thickness of the multi-layered laminate structure may be any suitable thickness for a substantially transparent container holding a product and is typically between 200 microns and 400 microns, for example between 200 microns to 275 microns.

In addition to the container providing the traditional product protection from moisture loss and flavor loss, the container provides protection of a product, in particular a product containing dyes, lakes or both from discoloration as observed by the human eye. Such discoloration can occur when the container is exposed to light, in particular to sunlight. Exposure to light can be for a period of up to two years which can be equivalent to up to 12 weeks with an equivalent energy of 49.2 $kJ/m^2$.

To provide protection against ultra violet light, the multi-layer laminate structure contains an effective amount of at least one ultra violet light absorber, including but not limited to benzophenone, benzotriazole, hydroxyphenyl-triazine, and cerium oxide. Effective amounts are typically 0.05% to 1% by weight, preferably up to 0.1% by weight. The ultra violet light absorbers can be in a single layer or combination of layers. In one aspect, the ultra violet light absorber is present in at least one of the middle layers of the laminate. It is desired to have the ultra violet light absorber in a middle or several middle layers as such absorbers present in a surface layer may rub off or near a layer adjacent the product could migrate into the product resulting in blooming. The migration levels of the ultra violet absorbers to the surface of the multi-layer container, for example benzotriazole from the middle layers, are less than the limit of detection at 21 ppb (0.0033 mg/dm2).

The ultra violet absorbers can be supplied by companies such as Ciba Specialty Chemicals. Tinuvin 326 [2-(2-Hydroxy-3-tert-butyl-5-methylphenyl)-5-chloro-2H-benzotriazole] and Tinuvin 234 [2-(2H Benzotrialzol-2-yl)-4,6-bis (1-methyl-1-phenylethyl)phenol].

The multi-layer laminate structure of the container provides less than 10% transmission of the ultra violet light between 280 nm and 400 nm, between 280 nm and 380 nm, or between 280 nm and 370 nm.

The apparent clarity of the overall product depends on the contact clarity, which can be defined by the interaction between package and the surface of the product. The refractive index of such a product can be readily measured at the surface using a refractometer and will be dependant on the nature of water and humectants which are typically present in a toothpaste gel (see U.S. Pat. No. 6,669,929 and US Publication 2004/013924 and references therein for examples). Therefore, a suitably matched product in container will result in an enhanced overall transparency through the package and allow the user to more readily observe aesthetic or functional features of the product.

The container and product system of the instant invention has good appearance and provides improved contact clarity similar to that of a glass container but without the weight concern and breakage associated with a glass container. The clear package reassures the consumer that the product is still effective.

Although the container may appear hazy when empty (due to air sealed in the laminate), when filled with the product, the container accentuates light transmittance and absorption of certain colors. This enhances the color of the product making the product appear pleasing to the consumer. The contact clarity occurs through the combination of colors in the product and its refractive index. The color does not fade over the useful life of the product.

The following table demonstrates a laminate structure of the instant invention compared to other films:

| | 276 micron | Mylar ® LBT 12-23 micron | Kuristar ™ C 14 micron |
|---|---|---|---|
| Gloss | | | |
| Parallel | 56.0-83.2 | | |
| Perpendicular | 57.6-87.4 | | |
| Transmittance | 83.4-92.4 | | 93.0 |
| Haze | 28.3-39.3 | 4.5-9.0 | 2.9 |
| Clarity | 90.2-95.4 | | |

Total transmittance, haze, and clarity as measured by ASTM D1003 and ASTM E 2387. Gloss is measured by ASTM D2457 Standard Test Method for Specular Gloss of Plastic Films and Solid Plastics at a 60° angle for intermediate gloss films.

EXAMPLE

A multi-layer tubular container is prepared in accordance with the present invention. The container has improved mechanical properties and has an interlayer bond strength between 2 Newton per 15 mm strip and 6 Newton per 15 mm strip and more particularly up at least 4 Newton per 15 mm strip and does not delaminate under normal consumer usage. The interlayer bond strength can be determined with a tension/compression apparatus capable of applying up to 9 kgf at a tensile or compressive speed of 100 mm/minute. An instrument that meets these specifications can be obtained from Instron Corp., Canton, Ohio. (Reference ASTM D883 and ASTM D638.)

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We claim:

1. A dentifrice container and product system comprising (a) a tubular container adapted to house a product, the container comprising a substantially transparent multi-layered laminate body comprising a surface layer, a layer adjacent the product and one or more middle layers positioned between the surface layer and the layer adjacent the product, wherein the body comprises 0.05% to 1% by weight of an ultra violet light absorber based on total weight of the body such that the body allows less than 10% transmission of the ultra violet light between 280 nm and 400 nm, and wherein the ultra violet light absorber is incorporated in one or more of the middle layers of the multi-layered laminate body so that any ultra violet absorber concentration at a surface of the multi-layered laminate body is due to migration of the ultra violet absorbers from the one or more middle layers and is less than 0.0033 mg/dm$^2$; and (b) a dentifrice product housed in the container, the dentifrice product comprising dyes, lakes, or both.

2. The system of claim 1 wherein the body provides less than 10% transmission of the ultra violet light between 280 nm and 380 nm.

3. The system of claim 2 wherein the body provides less than 10% transmission of the ultra violet light between 280 nm and 370 nm.

4. The system of claim 1 wherein the body comprises 0.05% to 0.1wt % of an ultra violet light absorber based on total weight of the body.

5. The system of claim 4 wherein the ultra violet light absorber comprises at least one compound selected from the group consisting of benzophenone, benzotriazole, hydroxy-phenyl-triazine, and cerium oxide.

6. The system of claim 1 wherein the refractive index of the dentifrice product is about 1.33 to about 1.47.

7. The system of claim 6 wherein the refractive index of the dentifrice product is about 1.40 to about 1.46.

8. The system of claim 1 wherein the container further comprises a dispensing end.

9. The system of claim 8 wherein the dispensing end is opaque.

10. The system of claim 1 wherein the container has a degree of haze when empty and when filled with the product the container provides clear visibility of the dentifrice product, the degree of haze ranging from 28.3 to 39.3 as measured by ASTM D1003.

11. A dentifrice container and system comprising (a) a tubular container adapted to house a product, the container comprising a substantially transparent multi-layered laminate body comprising a surface layer, a layer adjacent the product and one or more middle layers positioned between the surface layer and the layer adjacent the product, wherein the body comprises 0.05% to 1% by weight of at least one ultra violet light absorber based on total weight of the body, and wherein the at least one ultra violet light absorber is incorporated in one or more of the middle layers of the multi-layered laminate body so that any ultra violet absorber concentration at a surface of the multi-layered laminate body is due to migration of the ultra violet absorbers from the one or more middle layers and is less than 0.0033 mg/dm$^2$; and (b) a dentifrice product housed in the container, the dentifrice product comprising dyes, lakes, or both.

12. The system of claim 11 wherein the dentifrice product has a refractive index between 1.33 to about 1.47.

13. The system of claim 12 wherein the refractive index of the dentifrice product is about 1.40 to about 1.46.

14. The system of claim 13 wherein the refractive index of the dentifrice product is about 1.43 to about 1.45.

15. The system of claim 11 wherein the body allows less than 10% transmission of the ultra violet light between 280 nm and 400 nm.

16. The system of claim 15 wherein the body provides less than 10% transmission of the ultra violet light between 280 nm and 380 nm.

17. The system of claim 16 wherein the body provides less than 10% transmission of the ultra violet light between 280 nm and 370 nm.

18. The system of claim 11 wherein the ultra violet light absorber comprises at least one compound selected from the group consisting of benzophenone, benzotriazole, hydroxy-phenyl-triazine, and cerium oxide.

19. The system of claim 11 wherein the container has a degree of haze when empty and when filled with the product the container provides clear visibility of the dentifrice product, the degree of haze ranging from 28.3 to 39.3 as measured by ASTM D1003.

20. A dentifrice container and product system comprising (a) a tubular container adapted to house a product, the container comprising a substantially transparent multi-layered laminate body comprising 5 to 12 layers of flexible materials including a surface layer, a layer adjacent the product and one or more middle layers positioned between the surface layer and the layer adjacent the product, wherein the body comprises 0.05% to 1% by weight of an ultra violet light absorber based on total weight of the body such that the body allows less than 10% transmission of the ultra violet light between 280 nm and 400 nm, and wherein the ultra violet light absorber is incorporated in one or more of the middle layers of the multi-layered laminate body so that any ultra violet absorber concentration at a surface of the multi-layered laminate body is due to migration of the ultra violet absorbers from the one or more middle layers and is less than 0.0033 mg/dm$^2$; and (b) a dentifrice product housed in the container, the dentifrice product comprising dyes, lakes, or both, wherein the container has a degree of haze when empty and when filled with the product the container provides clear visibility of the dentifrice product, the degree of haze ranging from 28.3 to 39.3 as measured by ASTM D1003.

* * * * *